US009972249B2

(12) United States Patent
Zhang et al.

(10) Patent No.: US 9,972,249 B2
(45) Date of Patent: May 15, 2018

(54) PIXEL STRUCTURE AND DRIVING METHOD THEREOF, ORGANIC LIGHT EMITTING DISPLAY PANEL AND DISPLAY APPARATUS

(71) Applicants: BOE TECHNOLOGY GROUP CO., LTD., Beijing (CN); BEIJING BOE DISPLAY TECHNOLOGY CO., LTD., Beijing (CN)

(72) Inventors: Kan Zhang, Beijing (CN); Dianzheng Dong, Beijing (CN); Bin Zhang, Beijing (CN); Qiang Zhang, Beijing (CN); Guangxing Wang, Beijing (CN); Pengming Chen, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 0 days. days.

(21) Appl. No.: 15/526,152

(22) PCT Filed: Nov. 8, 2016

(86) PCT No.: PCT/CN2016/104973

§ 371 (c)(1),
(2) Date: May 11, 2017

(87) PCT Pub. No.: WO2017/118206

PCT Pub. Date: Jul. 13, 2017

(65) Prior Publication Data

US 2018/0082637 A1 Mar. 22, 2018

(30) Foreign Application Priority Data

Jan. 4, 2016 (CN) ..... 2016 1 0006810

(51) Int. Cl.
*G09G 3/3258* (2016.01)
*G09G 3/3208* (2016.01)

(52) U.S. Cl.
CPC ..... *G09G 3/3258* (2013.01); *G09G 3/3208* (2013.01); *G09G 2300/0465* (2013.01); *G09G 2300/0861* (2013.01); *G09G 2330/02* (2013.01)

(58) Field of Classification Search
CPC .. G09G 3/3208; G09G 3/3225; G09G 3/3258; G09G 2300/0861;
(Continued)

(56) References Cited

U.S. PATENT DOCUMENTS

2006/0139257 A1* 6/2006 Kwak ..... G09G 3/3233 345/76
2007/0024541 A1* 2/2007 Ryu ..... G09G 3/3233 345/76
(Continued)

FOREIGN PATENT DOCUMENTS

CN 1494048 A 5/2004
CN 102654975 A 9/2012
(Continued)

OTHER PUBLICATIONS

International Search Report and Written Opinion dated Feb. 7, 2017; PCT/CN2016/104973.
The First Chinese Office Action dated May 24, 2017; Appln. No. 201610006810.7.

*Primary Examiner* — Kent Chang
*Assistant Examiner* — Sujit Shah
(74) *Attorney, Agent, or Firm* — Ladas & Parry LLP

(57) ABSTRACT

A pixel structure, a driving method of the pixel structure, an organic light emitting display panel and a display apparatus. The pixel structure includes N light emitting devices, pixel compensation circuits connected with the light emitting devices in one-to-one correspondence, one potential conversion circuit, and one voltage input control circuit. The pixel compensation circuits are connected to the same potential conversion circuit and the same voltage input control circuit, so that pixel compensation circuits share one potential conversion circuit and one voltage input control circuit, the occupation area of the pixel compensation circuits in pixel regions can be reduced, so that the aperture ratio of each pixel region is improved.

20 Claims, 9 Drawing Sheets

(58) Field of Classification Search
CPC ... G09G 2300/0426; G09G 2300/0465; G09G 3/3233; G09G 3/3266; G09G 3/3275; G09G 2300/0819; G09G 2300/0852; G09G 2310/0262; G09G 2320/00; H01L 27/3211; H01L 27/3262; H01L 27/3265; H01L 27/3276
See application file for complete search history.

(56) References Cited

U.S. PATENT DOCUMENTS

| | | | | |
|---|---|---|---|---|
| 2007/0103405 | A1* | 5/2007 | Kwak | G09G 3/3233 345/76 |
| 2014/0347405 | A1 | 11/2014 | Kumeta et al. | |
| 2015/0049125 | A1* | 2/2015 | Lee | G09G 3/3233 345/690 |

FOREIGN PATENT DOCUMENTS

| | | | |
|---|---|---|---|
| CN | 102968954 | A | 3/2013 |
| CN | 202855269 | A | 4/2013 |
| CN | 104157239 | A | 11/2014 |
| CN | 104464607 | A | 3/2015 |
| CN | 204680360 | U | 9/2015 |
| CN | 105405395 | A | 3/2016 |
| KR | 1020090048823 | A | 5/2009 |
| KR | 20090073688 | A | 7/2009 |

* cited by examiner

PIXEL STRUCTURE AND DRIVING METHOD THEREOF, ORGANIC LIGHT EMITTING DISPLAY PANEL AND DISPLAY APPARATUS

TECHNICAL FIELD

Embodiments of the present disclosure relate to a pixel structure, a driving method of the pixel structure, an organic light emitting display panel and a display apparatus.

BACKGROUND

Organic light emitting diode (OLED) displays have become one of hotspots in the field of research on a flat panel display nowadays. Compared to liquid crystal displays (LCDs), OLED displays have advantages such as low energy consumption, low production cost, self-illumination, wide viewing angle, high response speed and the like, and thus, currently, in the display field of mobile phone, digital camera and the like, OLED displays have begun to replace the conventional LCDs. In an OLED display, the design of a pixel compensation circuit for controlling a light emitting device to emit light is a core technical content of the OLED display, and is of great research significance.

For example, an OLED display includes a plurality of pixel regions, and each pixel region includes one light emitting device and one pixel compensation circuit which is correspondingly connected with the light emitting device and is used for driving the light emitting device to emit light. The pixel compensation circuit, for example, includes a compensation module and a control module for providing a power voltage and a reference signal to the compensation module, and each module, for example, includes a plurality of switching transistors. Therefore, in the OLED display, such the pixel compensation circuit may occupy a relatively large area in the pixel region, so that the pixel aperture ratio of the OLED display is reduced.

SUMMARY

Embodiments of the present disclosure provide a pixel structure, a driving method of the pixel structure, an organic light emitting display panel and a display apparatus. By making a plurality of pixel compensation circuits share a same voltage input control circuit and a same potential conversion circuit, the structure of each pixel compensation circuit can be simplified so as to improve an aperture ratio of a pixel region.

An embodiment of the present disclosure provides a pixel structure, comprising N light emitting devices, a first power supply end, a second power supply end, a reference signal end, a first potential conversion end, a second potential conversion end, a charging control end, a light emitting control end, one potential conversion circuit, one voltage input control circuit, and pixel compensation circuits connected with first ends of the light emitting devices in one-to-one correspondence, wherein N is a positive integer greater than 0;

the potential conversion circuit comprises a first input end, a second input end, a third input end, a first control end, a second control end, a first output end and a second output end, the first input end is connected with the first power supply end, the second input end is connected with the second power supply end, the third input end is connected with the reference signal end, the first control end is connected with the first potential conversion end, the second control end is connected with the second potential conversion end, the first output end is connected with each pixel compensation circuit, and the second output end is connected with a second end of each light emitting device; the potential conversion circuit is configured to provide a voltage of the first power supply end to each light emitting device and simultaneously provide a voltage of the reference signal end to each pixel compensation circuit under control of the first potential conversion end, and respectively provide a voltage of the second power supply end to each light emitting device and each pixel compensation circuit under control of the second potential conversion end;

the voltage input control circuit comprises an input end, a first output end, a second output end, a first control end and a second control end, the input end is connected with the first power supply end, the first output end and the second output end of the voltage input control circuit are respectively connected with each pixel compensation circuit, the first control end of the voltage input control circuit is connected with the charging control end, and the second control end of the voltage input control circuit is connected with the light emitting control end; the voltage input control circuit is configured to provide the voltage of the first power supply end to each pixel compensation circuit under control of the charging control end so as to charge each pixel compensation circuit, and provide the voltage of the first power supply end to each pixel compensation circuit under control of each light emitting control end so as to control the pixel compensation circuit to drive the light emitting device to emit light; and both the voltage of the first power supply end and the voltage of the reference signal end are higher than the voltage of the second power supply end.

Another embodiment of the present disclosure provides a driving method of the above-mentioned pixel structure, comprising: a charging stage, a discharging stage, a maintaining stage and a light emitting stage, wherein during the charging stage, the potential conversion circuit provides the voltage of the first power supply end to a second end of each light emitting device and simultaneously provides the voltage of the reference signal end to a second node in each pixel compensation circuit under control of the first potential conversion end; the voltage input control circuit provides the voltage of the first power supply end to a first node in each pixel compensation circuit under control of the charging control end; and the compensation control module implements charging under control of the first node and the second node together;

during the discharging stage, the potential conversion circuit provides the voltage of the first power supply end to the second end of each light emitting device and simultaneously provides the voltage of the reference signal end to the second node in each pixel compensation circuit under control of the first potential conversion end; the data writing module provides a signal of the data signal end to a first end of the driving control module under control of the scanning signal end; and the compensation control module enables the first node to be electrically conducted with the first end of the driving control module under control of the compensation control end and stores both a threshold voltage of the driving control module and a voltage of the first end of the driving control module to the first node;

during the maintaining stage, the potential conversion circuit respectively provides the voltage of the second power supply end to the second end of the light emitting device and the second node in each pixel compensation circuit under control of the second potential conversion end; and during the light emitting stage, the potential conversion circuit respectively provides the voltage of the second power supply end to the second end of each light emitting device and the second node in each pixel compensation circuit under control of the second potential conversion end; the voltage input control circuit provides the voltage of the first power supply end to a third end of the driving control module in each pixel compensation circuit under control of the light emitting control end; and the driving control module drives the light emitting device to emit light under control of the first node and the third end of the driving control module.

Another embodiment of the present disclosure provides an organic light emitting display panel, comprising: M columns of regions arranged in a matrix, and above-mentioned pixel structures corresponding to each row of regions, wherein in each pixel structure, a number of the light emitting devices is the same; M is equal to N; and both the light emitting devices and the pixel compensation circuits in each pixel structure are arranged in regions in the corresponding rows, and one light emitting device and one pixel compensation circuit connected with the one light emitting device are arranged in one of the regions.

Another embodiment of the present disclosure provides a display apparatus, comprising the above-mentioned organic light emitting display panel.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Specific implementation modes of a pixel structure, a driving method of the pixel structure, an organic light emitting display panel and a display apparatus which are provided by embodiments of the present disclosure will be illustrated in detail in connection with drawings.

Figure 1A:
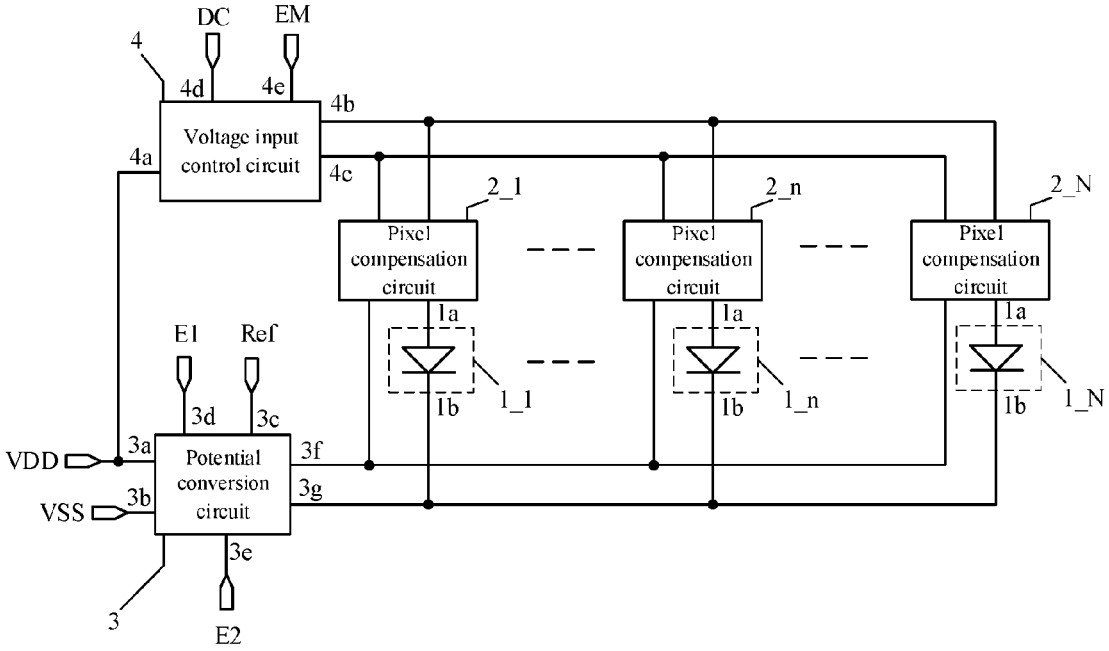
FIG. 1*a* is a structural schematic diagram I of a pixel structure provided by an embodiment of the present disclosure.

An embodiment of the present disclosure provides a pixel structure. As illustrated in FIG. 1*a*, the pixel structure includes N light emitting devices 1_n (n=1, 2, 3, . . . N), and pixel compensation circuits 2_n each correspondingly connected with a first end 1*a* of one light emitting device 1_n; the pixel structure further includes a first power supply end VDD, a second power supply end VSS, a reference signal end Ref, a first potential conversion end E1, a second potential conversion end E2, a charging control end DC, a light emitting control end EM, one potential conversion circuit 3 and one voltage input control circuit 4. In the pixel structure, N is a positive integer greater than 0, and for example, N is a positive integer greater than or equal to 2, so that a plurality of pixel compensation circuits 2_n share one potential conversion circuit 3 and one voltage input control circuit 4.

A first input end 3*a* of the potential conversion circuit 3 is connected with the first power supply end VDD, a second input end 3*b* is connected with the second power supply end VSS, a third input end 3*c* is connected with the reference signal end Ref a first control end 3*d* is connected with the first potential conversion end E1, a second control end 3*e* is connected with the second potential conversion end E2, a first output end 3*f* is connected with each pixel compensation circuit 2_n, and a second output end 3*g* is connected with a second end 1*b* of each light emitting device 1_n; the potential conversion circuit 3 is configured for, under control of the first potential conversion end E1, providing a voltage of the first power supply end VDD to each light emitting device 1_n and simultaneously providing a voltage of the reference signal end Ref to each pixel compensation circuit 2_n. and, under control of the second potential conversion end E2, providing a voltage of the second power supply end VSS to each light emitting device 1_n and each pixel compensation circuit 2_n respectively.

An input end 4*a* of the voltage input control circuit 4 is connected with the first power supply end VDD, a first output end 4*b* and a second output end 4*c* are respectively connected with each pixel compensation circuit 2_n (as illustrated in FIG. 1*a*, each pixel compensation circuit 2_n is connected with the first output end 4*b* and the second output end 4*c*), a first control end 4*d* is connected with the charging control end DC, and a second control end 4*e* is connected with the light emitting control end EM; the voltage input control circuit 4 is configured for providing the voltage of the first power supply end VDD to each pixel compensation circuit 2_n under the control of the charging control end DC so as to charge each pixel compensation circuit 2_n, and providing the voltage of the first power supply end VDD to each pixel compensation circuit 2_n under the control of the light emitting control end EM so as to control the pixel compensation circuit 2_n to drive the light emitting device 1_n to emit light.

Both the voltage of the first power supply end VDD and the voltage of the reference signal end Ref are higher than the voltage of the second power supply end VSS.

The pixel structure provided by the embodiment of the present disclosure includes N (N is the positive integer greater than 0) light emitting devices, pixel compensation circuits connected with the light emitting devices in one-to-one correspondence, one potential conversion circuit and one voltage input control circuit; and the pixel structure provided by the embodiment of the present disclosure can achieve an effect that a plurality of pixel compensation circuits are all connected with the same potential conversion circuit and the same voltage input control circuit, which is equivalent to an effect that a plurality of pixel compensation circuits share one potential conversion circuit and one voltage input control circuit, and compared with a configuration that each pixel compensation circuit includes one control module for controlling a power voltage and the input of a reference signal, a configuration adopted by the pixel structure provided by the embodiment of the present disclosure can simplify the structure of each pixel compensation circuit, so that the occupation area of the pixel compensation circuits in pixel regions can be reduced, thereby improving the aperture ratio of each pixel region.

Figure 1B:
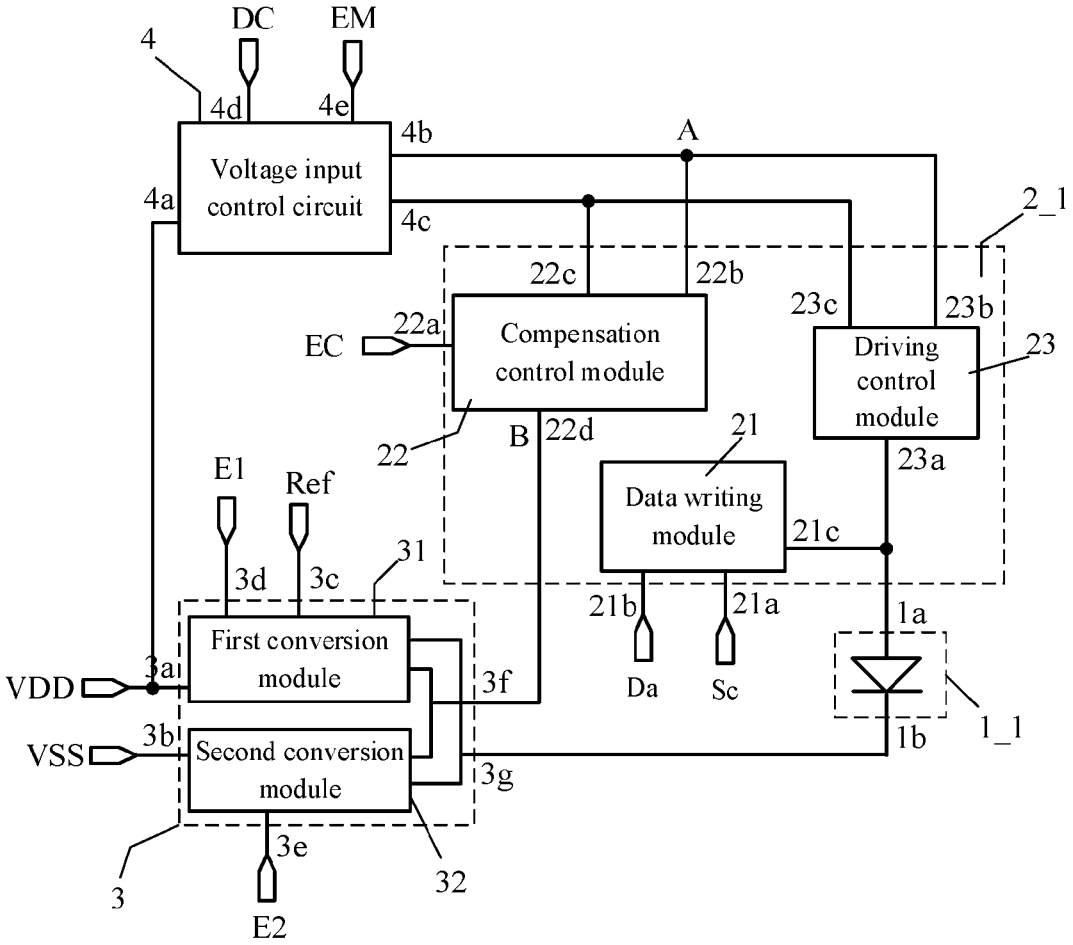
FIG. 1*b* is a structural schematic diagram II of the pixel structure provided by the embodiment of the present disclosure.

For example, in the pixel structure provided by the embodiment of the present disclosure, as illustrated in FIG. 1*b* (which shows the case that N is equal to 1 is taken as an example), the pixel compensation circuit 2_1 includes: a data writing module 21, a compensation control module 22 and a driving control module 23.

In the data writing module 21, a first end 21*a* is connected with a scanning signal end Sc, a second end 21*b* is connected with a data signal end Da, and a third end 21*c* is respectively connected with a first end 23*a* of the driving control module 23 and the first end 1*a* of the light emitting device 1_1; and the data writing module 21 is configured for providing a signal of the data signal end Da to the first end 23*a* of the driving control module 23 under the control of the scanning signal end Sc.

In the compensation control module 22, a first end 22*a* is connected with the compensation control end EC, a second end 22*b* is respectively connected with the first output end 4*b* of the voltage input control circuit 4, a second end 23*b* of the driving control module 23, and a first node A which is connected with the first output end 4*b* of the voltage input control circuit 4 and the second end 23*b* of the driving control module 23, a third end 22*c* is respectively connected with the second output end 4*c* of the voltage input control circuit 4 and a third end 23*c* of the driving control module 23, and a fourth end 22*d* is connected with the first output end 3*f* of the potential conversion circuit 3 and a second node B which is connected with both the compensation control module 22 and the potential conversion circuit 3; and the compensation control module 22 is configured for implementing charging under the control of the first output end 3*f* of the potential conversion circuit 3 and the first output end 4*b* of the voltage input control circuit 4, and enabling the first node A to be electrically conducted with the first end 23*a* of the driving control module 23 under the control of the compensation control end EC so as to store both the threshold voltage of the driving control module 23 and the voltage of the first end 23*a* of the driving control module 23 to the first node A.

The driving control module 23 is configured for driving the light emitting device 1_1 correspondingly connected with the pixel compensation circuit 2_1 to emit light under the control of the first node A and the second output end 4*c* of the voltage input control circuit 4.

According to the pixel compensation circuit, by cooperation of three modules: the data writing module, the compensation control module and the driving control module, a working current for the driving control module in each pixel compensation circuit to drive the light emitting device to emit light can be only related to a voltage of the data signal end and the voltage of the reference signal end and unrelated to the threshold voltage in the driving control module and the voltage of the first power supply end, and thus, the influence which the threshold voltage and an IR Drop incur on the current flowing through the light emitting device can be avoided, so that the working current for driving the light emitting device to emit light is kept stable, and uniformity of image brightness of the display region in a display apparatus can be alleviated.

For example, in the pixel structure provided by the embodiment of the present disclosure, as illustrated in FIG. 1*b*, the potential conversion circuit 3 may include a first conversion module 31 and a second conversion module 32.

The first conversion module 31 is respectively connected with the first power supply end VDD, the reference signal end Ref, the first potential conversion end E1, the first output end 3*f* of the potential conversion circuit 3, and the second output end 3*g* of the potential conversion circuit 3; the first conversion module 31 is configured for, under the control of the first potential conversion end E1, providing the voltage of the reference signal end Ref to each pixel compensation circuit 2_1 and simultaneously providing the voltage of the first power supply end VDD to each light emitting device 1_1.

The second conversion module 32 is respectively connected with the second power supply end VSS, the second potential conversion end E2, the first output end 3*f* of the potential conversion circuit 3, and the second output end 3*g* of the potential conversion circuit 3; and the second conversion module is configured for respectively providing the voltage of the second power supply end VSS to each light emitting device 1_1 and each pixel compensation circuit 2_1 under the control of the second potential conversion end E2.

The pixel structure provided by an embodiment of the present disclosure will be illustrated in details in connection with specific examples. It should be noted that the examples of the present disclosure only aim to explain the present disclosure better, but do not limit the present disclosure.

For example, in the pixel structure provided by the embodiment of the present disclosure, as illustrated in FIG.

Figure 3A:
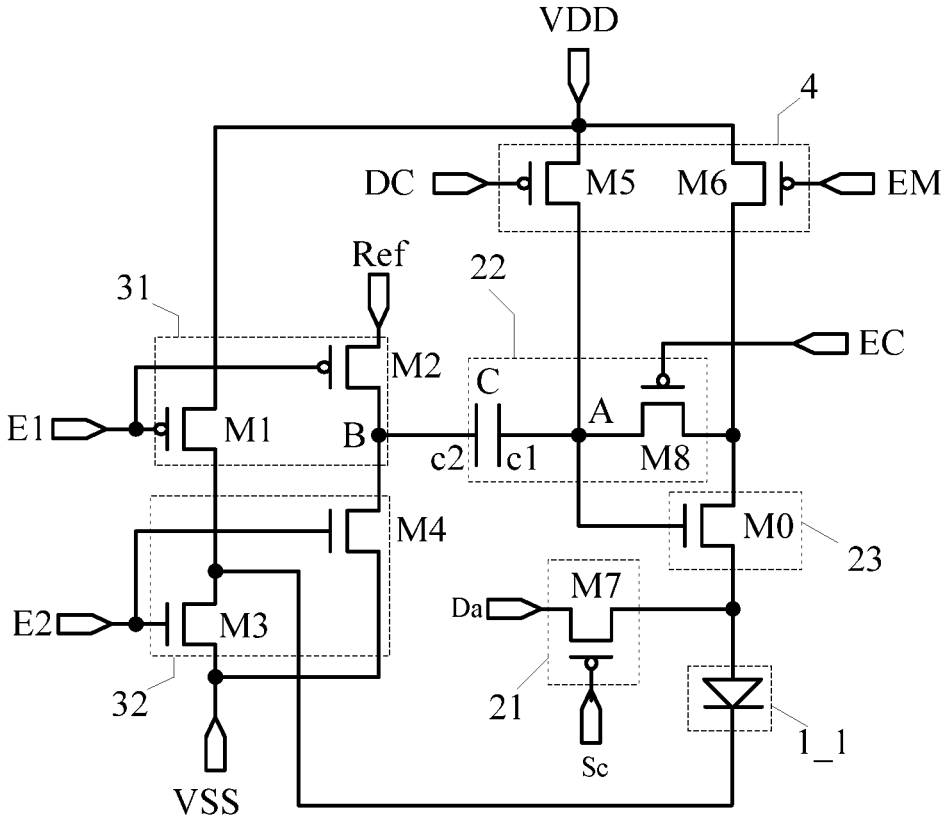
FIG. 3*a* is a specific structural schematic diagram III of the pixel structure provided by the embodiment of the present disclosure.
Figure 3B:
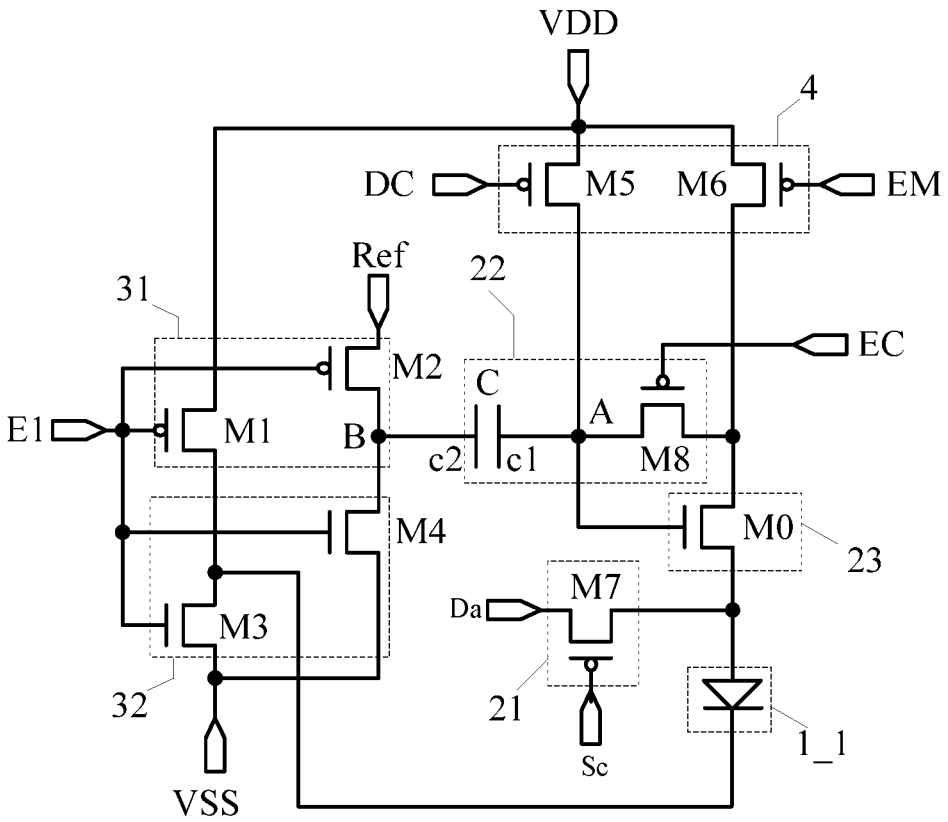
FIG. 3*b* is a specific structural schematic diagram IV of the pixel structure provided by the embodiment of the present disclosure.

2*a* to FIG. 3*b* (showing the case that N is equal to 1 is taken as an example), the driving control module 23 may include a driving transistor M0; a gate electrode M01 of the driving transistor M0 is connected with the first node A, a source electrode M02 is connected with the second output end 4*c* of the voltage input control circuit 4, and a drain electrode M03 is connected with the first end 1*a* of the light emitting device 1_1.

For example, the light emitting device in the pixel structure provided by the embodiment of the present disclosure is an organic light emitting diode. The light emitting device implements light emission under the action of the saturation current of the driving transistor.

For example, in the pixel structure provided by the embodiment of the present disclosure, the driving transistor for driving the light emitting device to emit light is an N-type transistor. In order to ensure that the driving transistor can normally work, correspondingly the voltage of the first power supply end is a positive voltage, and the voltage of the second power supply end is lower than the voltage of the first power supply end.

For example, in the pixel structure provided by the embodiment of the present disclosure, as illustrated in FIG. 2*a* to FIG. 3*b*, the first conversion module 31 may include: a first switching transistor M1 and a second switching transistor M2; a gate electrode M11 of the first switching transistor M1 is connected with the first potential conversion end E1, a source electrode M12 is connected with the first power supply end VDD, and a drain electrode M13 is connected with the second output end 3*g* of the potential conversion circuit 3; and a gate electrode M21 of the second switching transistor M2 is connected with the first potential conversion end E1, a source electrode M22 is connected with the reference signal end Ref, and a drain electrode M23 is connected with the first output end 3*f* of the potential conversion circuit 3.

Figure 2A:
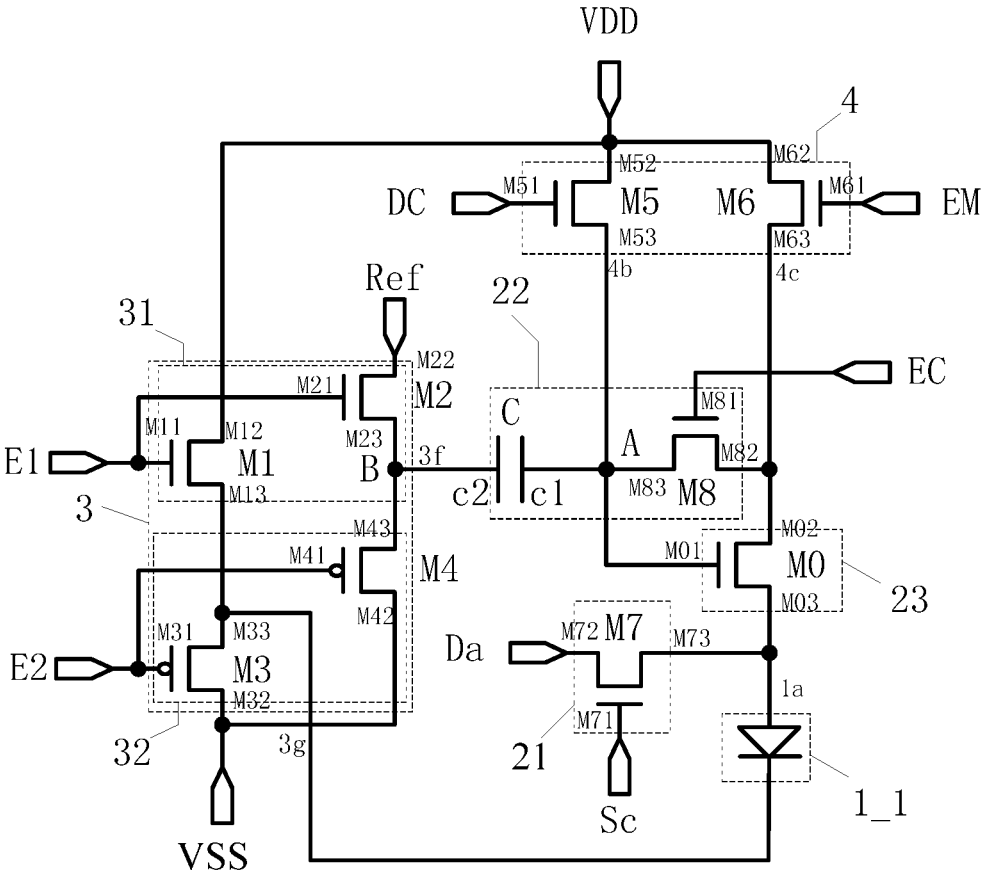
FIG. 2*a* is a specific structural schematic diagram I of the pixel structure provided by the embodiment of the present disclosure.
Figure 2B:
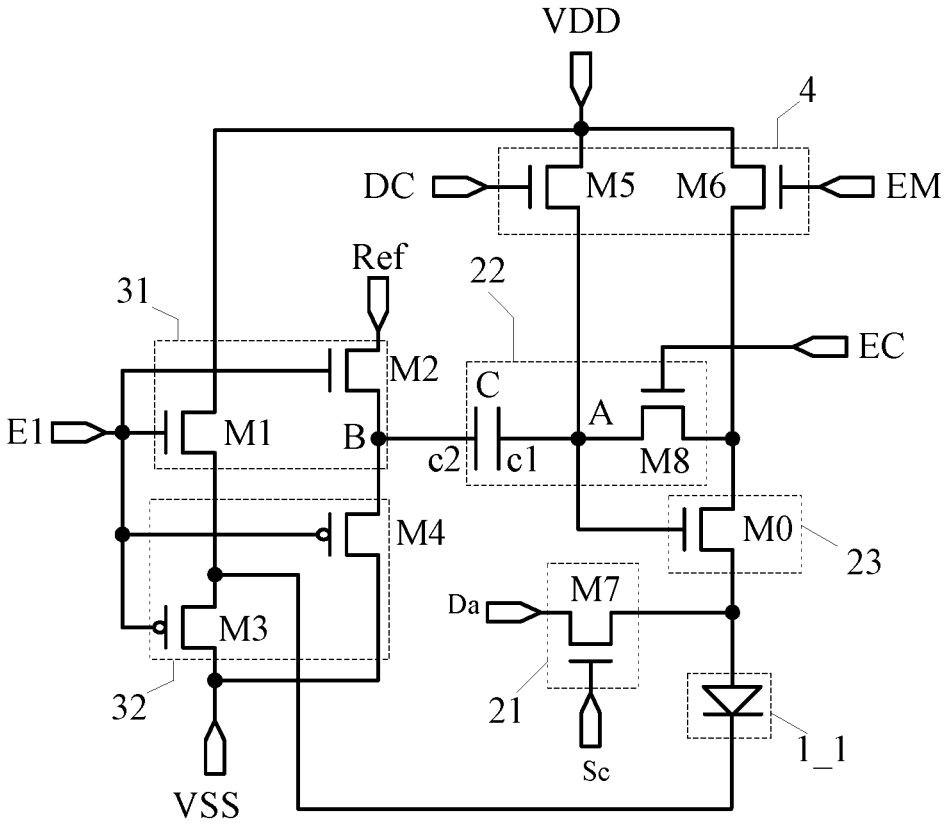
FIG. 2*b* is a specific structural schematic diagram II of the pixel structure provided by the embodiment of the present disclosure.

For example, in the pixel structure provided by the embodiment of the present disclosure, as illustrated in FIG. 2*a* and FIG. 2*b*, the first switching transistor M1 and the second switching transistor M2 can be N-type switching transistors; or, as illustrated in FIG. 3*a* and FIG. 3*b*, the first switching transistor M1 and the second switching transistor M2 also can be P-type switching transistors, which is not limited herein.

The above just exemplifies a specific structure of the first conversion module in the pixel structure, and for example, the specific structure of the first conversion module is not limited to the structure provided by the embodiment of the present disclosure, also may be other structures known by those skilled in the related art and is not limited herein.

For example, in the pixel structure provided by an embodiment of the present disclosure, as illustrated in FIG. 2*a* to FIG. 3*b*, the second conversion module 32 may include: a third switching transistor M3 and a fourth switching transistor M3; a gate electrode M31 of the third switching transistor M3 is connected with the second potential conversion end E2, a source electrode M32 is connected with the second power supply end VSS, and a drain electrode M33 is connected with the second output end 3*g* of the potential conversion circuit 3; and a gate electrode M41 of the fourth switching transistor M4 is connected with the second potential conversion end E2, a source electrode M42 is connected with the second power supply end VSS, and a drain electrode M43 is connected with the first output end 3*f* of the potential conversion circuit 3.

For example, in the pixel structure provided by the embodiment of the present disclosure, as illustrated in FIG. 2*a* and FIG. 2*b*, the third switching transistor M3 and the fourth switching transistor M4 can be P-type switching transistors; or, as illustrated in FIG. 3*a* and FIG. 3*b*, the third switching transistor M3 and the fourth switching transistor M4 also can be N-type switching transistors, which is not limited herein.

The above just exemplifies a specific structure of the second conversion module in the pixel structure, and for example, the specific structure of the first conversion module is not limited to the structure provided by the embodiment of the present disclosure, also may be other structures known by those skilled in the art, and is not limited herein.

Further, for example, in the pixel structure provided by an embodiment of the present disclosure, as illustrated in FIG. 2*b*, the first switching transistor M1 and the second switching transistor M2 are N-type switching transistors, and the third switching transistor M3 and the fourth switching transistor M3 are P-type switching transistors; or, as illustrated in FIG. 3*b*, the first switching transistor M1 and the second switching transistor M2 are P-type switching transistors, and the third switching transistor M3 and the fourth switching transistor M3 are N-type switching transistors. Therefore, the first potential conversion end E1 and the second potential conversion end E2 can be provided at the same signal end, so that the number of signal lines can be reduced, thereby further improving the aperture ratio of the pixel region.

For example, in the pixel structure provided by an embodiment of the present disclosure, as illustrated in FIG. 2*a* to FIG. 3*b*, the voltage input control circuit 4 includes: a fifth switching transistor M5 and a sixth switching transistor M6; a gate electrode M51 of the fifth switching transistor M5 is connected with the charging control end DC, a source electrode M52 is connected with the first power supply end VDD, and a drain electrode M53 is connected with the first output end 4*b* of the voltage input control circuit 4; and a gate electrode M61 of the sixth switching transistor M6 is connected with the light emitting control end EM, a source electrode M62 is connected with the first power supply end VDD, and a drain electrode M63 is connected with the second output end 4*c* of the voltage input control circuit 4.

For example, in the pixel structure provided by an embodiment of the present disclosure, as illustrated in FIG. 2*a* to FIG. 2*b*, the fifth switching transistor M5 can be an N-type switching transistor; or, as illustrated in FIG. 3*a* and FIG. 3*b*, the fifth switching transistor M5 also can be a P-type switching transistor, which is not limited herein.

For example, in the pixel structure provided by the embodiment of the present disclosure, as illustrated in FIG. 2*a* to FIG. 2*b*, the sixth switching transistor M6 can be an N-type switching transistor; or, as illustrated in FIG. 3*a* and FIG. 3*b*, the sixth switching transistor M6 also can be a P-type switching transistor, which is not limited herein.

The above just exemplifies a specific structure of the voltage input control circuit in the pixel structure, and for example, the specific structure of the voltage input control circuit is not limited to the structure provided by the embodiment of the present disclosure, also may be other structures known by those skilled in the art, and is not limited herein.

For example, in the pixel structure provided by the embodiment of the present disclosure, as illustrated in FIG. 2*a* to FIG. 3*b*, the data writing module 21 may include a seventh switching transistor M7; a gate electrode M71 of the seventh switching transistor M7 is connected with the scanning signal end Sc, a source electrode M72 is connected with the data signal end Da, and a drain electrode M73 is connected with the first end 1*a* of the light emitting device 1_1.

For example, in the pixel structure provided by the embodiment of the present disclosure, as illustrated in FIG. 2*a* to FIG. 2*b*, the seventh switching transistor M7 can be an N-type switching transistor; or, as illustrated in FIG. 3*a* and FIG. 3*b*, the seventh switching transistor M7 also can be a P-type switching transistor, which is not limited herein.

For example, in the pixel structure provided by the embodiment of the present disclosure, as illustrated in FIG. 2*a* to FIG. 3*b*, the compensation control module 22 includes: an eighth switching transistor M8 and a capacitor C; a gate electrode M81 of the eighth switching transistor M8 is connected with the compensation control end EC, a source electrode M82 is connected with the second output end 4*c* of the voltage input control circuit 4, and a source electrode M83 is connected with the first node A; and the capacitor C is connected between the first node A and the second node B.

For example, in the pixel structure provided by the embodiment of the present disclosure, as illustrated in FIG. 2*a* to FIG. 2*b*, the eighth switching transistor M8 can be an N-type switching transistor; or, as illustrated in FIG. 3*a* and FIG. 3*b*, the eighth switching transistor M8 also can be a P-type switching transistor, which is not limited herein.

Further, for example, the P-type switching transistor is turned off under the action of a high potential, and is turned on under the action of a low potential; and the N-type switching transistor is turned on under the action of the high potential, and is turned off under the action of the low potential.

It should be noted that in the pixel structure provided by an embodiment of the present disclosure, the driving transistors and the switching transistors may be thin film transistors (TFTs), also can be metal oxide semiconductor (MOS) field-effect transistors, and are not limited herein. In specific implementation, the source electrodes and the drain electrodes of these transistors can be interchanged, and are not specifically distinguished. In the process of describing the specific embodiments, illustration is carried out by taking a case that both the driving transistors and the switching transistors are the TFTs as an example.

By taking the pixel structure illustrated in FIG. 2*b* and FIG. 3*b* as the example, the working process of the pixel structure provided by an embodiment of the present disclosure will be described in connection with circuit timing diagrams. In the description below, "1" represents the high potential, "0" represents the low potential, and it should be noted that 1 and 0 are logic potentials, and only aim to explain the specific working process of the embodiment of the present disclosure better, rather than represent potentials applied to the gate electrode of each switching transistor in the specific implementation.

Embodiment I

Figure 4A:
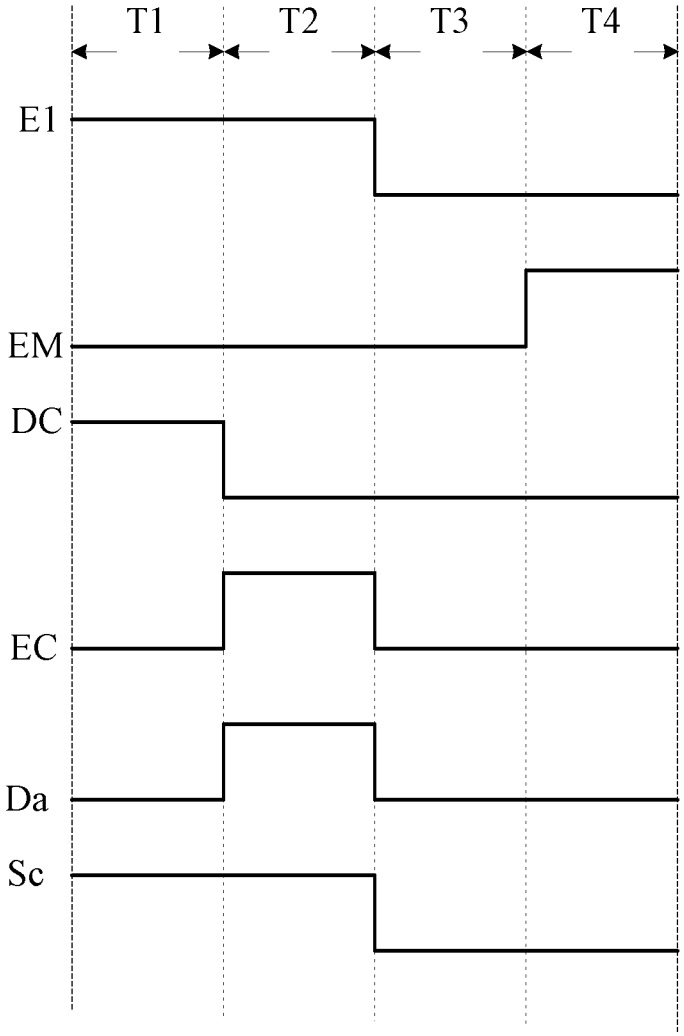
FIG. 4*a* is a circuit timing diagram of the pixel structure provided in FIG. 2*b;*

The pixel structure illustrated in FIG. 2*b* is taken as the example, both the third switching transistor M3 and the fourth switching transistor M4 are P-type switching transistors, and the rest of switching transistors are N-type switching transistors; and by taking a case that the voltage of the second power supply end VSS is 0V as an example, a corresponding input output timing diagram, as illustrated in FIG. 4*a*, includes four stages: a charging stage T1, a discharging stage T2, a maintaining stage T3 and a light emitting stage T4.

During the charging stage T1, E1=1, EM=0, DC=1, EC=0, Da=0 and Sc=1.

The first switching transistor M1, the second switching transistor M2, the fifth switching transistor M5 and the seventh switching transistor M7 are all turned on; and the third switching transistor M3, the fourth switching transistor M4, the sixth switching transistor M6 and the eighth switching transistor M8 are all turned off. The second switching transistor M2 which is turned on writes the voltage $V_{ref}$ of the reference signal end Ref into the second node B, and thus, the voltage of the second node B is that $V_B=V_{ref}$; the fifth switching transistor M5 which is turned on writes the voltage $V_{dd}$ of the first power supply end VDD into the first node A, and thus, the voltage of the first node A is that $V_A=V_{ref}$, the capacitor C starts to charge, and the driving transistor is turned on under the control of the first node; and the seventh switching transistor M7 which is turned on respectively writes a voltage of a low potential of the data signal end Da into the first end of the light emitting device 1_1, and the first switching transistor M1 which is turned on writes the voltage $V_{dd}$ of the first power supply end VDD into the second end of the light emitting device 1_1, and thus, the light emitting device 1_1 does not emit light.

During the discharging stage T2, E1=1, EM=0, DC=0, EC=1 Da=1 and Sc=1.

The first switching transistor M1, the second switching transistor M2, the seventh switching transistor M7 and the eighth switching transistor M8 are all turned on; and the third switching transistor M3, the fourth switching transistor M4, the fifth switching transistor M5 and the sixth switching transistor M6 are all turned off The second switching transistor M2 which is turned on writes the voltage $V_{ref}$ of the reference signal end Ref into the second node B, the voltage of the second node B is that $V_B=V_{ref}$; and the seventh switching transistor M7 which is turned on writes a voltage $V_{data}$ of a high potential of the data signal end Da into the drain electrode of the driving transistor M0; and the eighth switching transistor M8 which is turned on enables the driving transistor M0 to be converted to a diode, the diode is turned on, the capacitor C starts to discharge, until the voltage of the first node A is changed to $V_{data}+V_{th}$, the diode is turned off and the capacitor stops discharging, and at this moment, the voltage difference over both ends of the capacitor C is $V_{data}+V_{th}-V_{ref}$, so that storage of the threshold voltage $V_{th}$ of the driving transistor M0 is implemented at the position of the gate electrode of the driving transistor M0.

During the maintaining stage T3, E1=0, EM=0, DC=0, EC=0, Da=0 and Sc=0.

Both the third switching transistor M3 and the fourth switching transistor M4 are turned on; and the first switching transistor M1, the second switching transistor M2, the fifth switching transistor M5, the sixth switching transistor M6, the seventh switching transistor M7 and the eighth switching transistor M8 are all turned off. The third switching transistor M3 which is turned on writes the voltage 0 of the second power supply end V2 into the second end of the light emitting diode 1_1, and no voltage of the source electrode of the driving transistor M0 is written, and thus, the light emitting diode 1_1 does not emit light; and the third switching transistor M3 which is turned on writes the voltage 0 of the second power supply end V2 into the second node B, i.e., a second end c2 of the capacitor C, then a voltage of the second end c2 of the capacitor C is changed to 0 from $V_{ref}$, and according to the capacitor electricity conservation principle, in order to ensure that the voltage difference over both the ends of a first capacitor C1 is still $V_{data}+V_{th}-V_{ref}$, the voltage of the first end c1 of the capacitor C is jumped to $V_{data}+V_{th}-V_{ref}$ from $V_{data}+V_{th}$.

During the light emitting stage T4, E1=0, EM=1, DC=0, EC=0, Da=0 and Sc=0.

The third switching transistor M3, the fourth switching transistor M4 and the sixth switching transistor M6 are all turned on; and the first switching transistor M 1, the second switching transistor M2, the fifth switching transistor M5, the seventh switching transistor M7 and the eighth switching transistor M8 are all turned off The third switching transistor M3 which is turned on writes the voltage 0 of the second power supply end V2 into the second end of the light emitting device 1_1 and the second node B, i.e., the second end c2 of the capacitor C, so that the voltage of the second end c2 of the capacitor C is still equal to 0; the sixth switching transistor M6 which is turned on writes the voltage $V_{dd}$ of the first power supply end VDD into the source electrode of the driving transistor M0; and the driving transistor M0 works in a saturation state, and thus, according to current characteristics of the saturation state, it can be known that the working current I flowing through the driving transistor M0 and used for driving the light emitting device 1_1 to emit light meets a formula:

$$I=K(V_{gs}-V_{th})^2=K(V_{data}+V_{th}-V_{ref}-V_{th})^2=K(V_{data}-V_{ref})^2,$$

wherein K is a structural parameter, the value of K is relatively stable in the same structure, and K can be used as a constant. A gate source voltage of the driving transistor M0 is that $V_{gs}=V_{data}+V_{th}-V_{ref}$. It can be known from the formula that a driving current of the driving transistor M0 is only related to the voltage Vref of the reference signal end $R_{ef}$ and the voltage $V_{data}$ of the data signal end Da, but is unrelated to the threshold voltage $V_{th}$, of the driving transistor M0 and the voltage $V_{dd}$ of the first power supply end, and problems about the drift of the threshold voltage Vth, which is caused by a technical process and long-time operation of the driving transistor M0, and influence of IR Drop on the current flowing through the light emitting device are solved, so that the working current of the light emitting device 1_1 is kept stable, thereby ensuring that the light emitting device 1_1 normally works.

Embodiment II

Figure 4B:
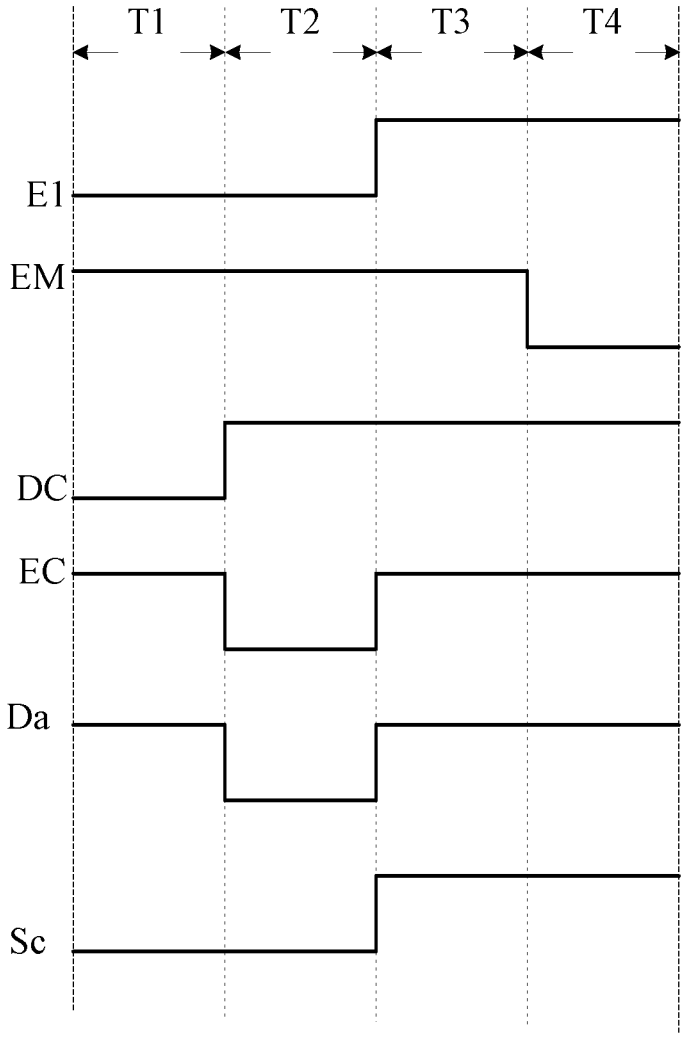
FIG. 4*b* is a circuit timing diagram of the pixel structure provided in FIG. 3*b*.

The pixel structure illustrated in FIG. 3*b* is taken as the example, both the third switching transistor M3 and the fourth switching transistor M4 are N-type switching transistors, and the rest of switching transistors are P-type switching transistors; each P-type switching transistor is turned on under the action of a low potential, and is turned off under the action of a high potential; each N-type switching transistor is turned on under the action of a high potential, and is turned off under the action of a low potential; and by taking a case that the voltage of the second power supply end is 0V as an example, a corresponding input output timing diagram, as illustrated in FIG. 4*b*, includes four stages: a charging stage T1, a discharging stage T2, a maintaining stage T3 and a light emitting stage T4.

During the charging stage T1, E1=0, EM=1, DC=0, EC=1, Da=1 and Sc=0.

The first switching transistor M1, the second switching transistor M2, the fifth switching transistor M5 and the seventh switching transistor M7 are all turned on; and the third switching transistor M3, the fourth switching transistor M4, the sixth switching transistor M6 and the eighth switching transistor M8 are all turned off. The second switching transistor M2 which is turned on writes the voltage $V_{ref}$ of the reference signal end Ref into the second node B, and thus, the voltage of the second node B is that $V_B=V_{ref}$; the fifth switching transistor M5 which is turned on writes the voltage $V_{dd}$ of the first power supply end VDD into the first node A, and thus, the voltage of the first node A is that $V_A=V_{ref}$, the capacitor C starts to charge, and the driving transistor is turned on under the control of the first node; and the seventh switching transistor M7 turned on respectively writes a voltage of a low potential of the data signal end Da into the first end of the light emitting device 1_1, and the first switching transistor M1 turned on writes the voltage $V_{dd}$ of the first power supply end VDD into the second end of the light emitting device 1_1, and thus, the light emitting device 1_1 does not emit light.

During the discharging stage T2, E1=0, EM=1, DC=1, EC=0, Da=0 and Sc=0.

The first switching transistor M1, the second switching transistor M2, the seventh switching transistor M7 and the eighth switching transistor M8 are all turned on; and the third switching transistor M3, the fourth switching transistor M4, the fifth switching transistor M5 and the sixth switching transistor M6 are all turned off The second switching transistor M2 which is turned on writes the voltage $V_{ref}$ of the reference signal end Ref into the second node B, the voltage of the second node B is that $V_B=V_{ref}$, and the seventh switching transistor M7 which is turned on writes a voltage $V_{data}$ of a high potential of the data signal end Da into the drain electrode of the driving transistor M0; and the eighth switching transistor M8 which is turned on enables the driving transistor M0 to be converted to a diode, the diode is turned on, the capacitor C starts to discharge, until the voltage of the first node A is changed into $V_{data}+V_{th}$, the diode is turned off and the capacitor stops discharging, and at the moment, a voltage difference of both ends of the capacitor C is $V_{data}+V_{th}-V_{ref1}$, so that storage of the threshold voltage $V_{th}$ of the driving transistor M0 is implemented at the position of the gate electrode of the driving transistor M0.

During the maintaining stage T3, E1=1, EM=1, DC=1, EC=1, Da=1 and Sc=1.

Both the third switching transistor M3 and the fourth switching transistor M4 are turned on; and the first switching transistor M1, the second switching transistor M2, the fifth switching transistor M5, the sixth switching transistor M6, the seventh switching transistor M7 and the eighth switching transistor M8 are all turned off. The third switching transistor M3 which is turned on writes the voltage 0 of the second power supply end V2 into the second end of the light emitting diode 1_1, and no voltage of the source electrode of the driving transistor M0 is written, and thus, the light emitting diode 1_1 does not emit light; and the third switching transistor M3 which is turned on writes the voltage 0 of the second power supply end V2 into the second node B, i.e., a second end c2 of the capacitor C, then a voltage of the second end c2 of the capacitor C is changed into 0 from $V_{ref}$, and according to the capacitor electricity conservation principle, in order to ensure that the voltage difference of both the ends of a first capacitor C1 is still $V_{data}+V_{th}-V_{ref}$, the voltage of a first end c1 of the capacitor C is jumped to $V_{data}+V_{th}-V_{ref}$ from $V_{data}+V_{th}$.

During the light emitting stage T4, E1=1, EM=0, DC=1, EC=1, Da=1 and Sc=1.

The third switching transistor M3, the fourth switching transistor M4 and the sixth switching transistor M6 are all turned on; and the first switching transistor M1, the second switching transistor M2, the fifth switching transistor M5, the seventh switching transistor M7 and the eighth switching transistor M8 are all turned off. The third switching transistor M3 which is turned on writes the voltage 0 of the second power supply end V2 into the second end of the light emitting device 1_1 and the second node B. i.e., the second end c2 of the capacitor C, so that the voltage of the second end c2 of the capacitor C is still equal to 0; the sixth switching transistor M6 which is turned on writes the voltage $V_{dd}$ of the first power supply end VDD into the source electrode of the driving transistor M0; and the driving transistor M0 works in a saturation state, and thus, according to current characteristics of the saturation state, it can be known that the working current I flowing through the driving transistor M0 and used for driving the light emitting device 1_1 to emit light meets a formula:

$$I=K(V_{gs}-V_{th})^2=K(V_{data}+V_{th}-V_{ref}-V_{th})^2=K(V_{data}-V_{ref})^2,$$

wherein K is a structural parameter, the value of K is relatively stable in the same structure, and K can be used as a constant. A gate source voltage of the driving transistor M0 is that $V_{gs}=V_{data}+V_{th}-V_{ref}$. It can be known from the formula that a driving current of the driving transistor M0 is only related to the voltage Vref of the reference signal end $R_{ef}$ and the voltage $V_{data}$ of the data signal end Da, but is unrelated to the threshold voltage $V_{th}$ of the driving transistor M0 and the voltage $V_{dd}$ of the first power supply end, and problems about the drift of the threshold voltage Vth, which is caused by a technical process and long-time operation of the driving transistor M0, and influence of IR Drop on the current flowing through the light emitting device are solved, so that the working current of the light emitting device 1_1 is kept stable, thereby ensuring that the light emitting device 1_1 normally works.

Based on the same inventive concept, an embodiment of the present disclosure further provides a driving method of the pixel structure, including: a charging stage, a discharging stage, a maintaining stage and a light emitting stage.

During the charging stage, under the control of the first potential conversion end, the potential conversion circuit provides a voltage of the first power supply end to a second end of each light emitting device and simultaneously provides a voltage of the reference signal end to a second node in each pixel compensation circuit; the voltage input control circuit provides the voltage of the first power supply end to a first node in each pixel compensation circuit under the control of the charging control end; the data writing module provides a signal of the data signal end to both a first end of the driving control module and a first end of the light emitting device under the control of the scanning signal end; the driving control module enables the first end and a third end to be conducted under the control of the compensation control end; and the compensation control module implements charging under the control of the first node and the second node together.

During the discharging stage, under the control of the first potential conversion end, the potential conversion circuit provides the voltage of the first power supply end to the second end of each light emitting device and simultaneously provides the voltage of the reference signal end to the second node in each pixel compensation circuit; the data writing module provides the signal of the data signal end to both the first end of the driving control module and the first end of the light emitting device under the control of the scanning signal end; and the compensation control module enables the first node to be electrically conducted with the first end of the driving control module under the control of the compensation control end and stores both a threshold voltage of the driving control module and a voltage of the first end of the driving control module to the first node.

During the maintaining stage, the potential conversion circuit respectively provides a voltage of the second power supply end to both the second end of the light emitting device and the second node in each pixel compensation circuit under the control of the second potential conversion end.

During the light emitting stage, the potential conversion circuit respectively provides the voltage of the second power supply end to both the second end of each light emitting device and the second node in each pixel compensation circuit under the control of the second potential conversion end; the voltage input control circuit provides the voltage of the first power supply end to the third end of the driving control module in each pixel compensation circuit under the control of the light emitting control end; and the driving control module drives the light emitting device to emit light under the control of the first node and the third end of the driving control module.

Figure 5:
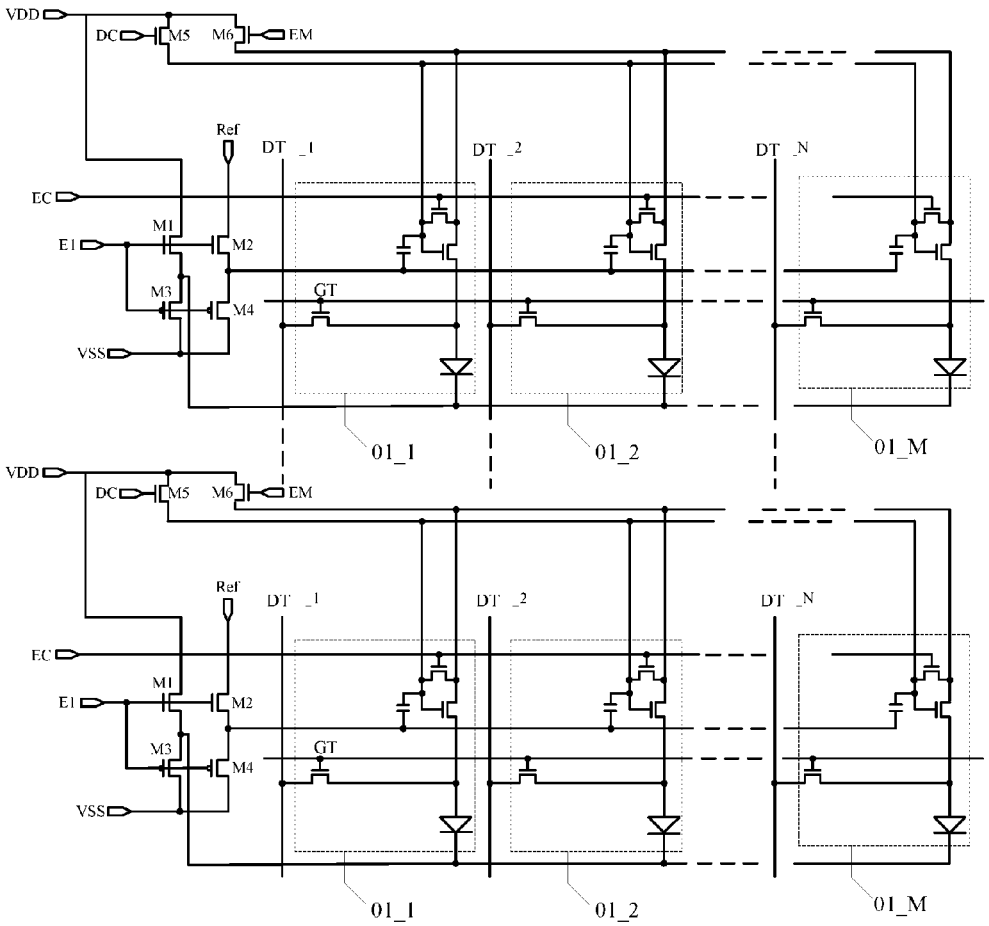
FIG. 5 is a structural schematic diagram of a pixel structure in an organic light emitting display panel provided by an embodiment of the present disclosure.

Based on the same inventive concept, an embodiment of the present disclosure further provides an organic light emitting display panel, as illustrated in FIG. 5, including M columns of regions 01 (with reference to 01_1 to 01_M) arranged in a matrix, and further including any one of the pixel structures provided by the embodiments of the present disclosure, which corresponds to each row of regions 01, the number of the light emitting devices being the same in each pixel structure, wherein M is equal to N; and both the light emitting devices and the pixel compensation circuits in each pixel structure are arranged in the regions 01 in the corresponding rows, and one light emitting device and one pixel compensation circuit connected with the light emitting device are arranged in one region 01.

For example, the organic light emitting display panel further includes a plurality of gate lines GT extending along a row direction of pixels and sequentially arranged and a plurality of data lines DT (with reference to DT_1 to DT_N) extending along a column direction of the pixels and sequentially arranged; each row of gate lines is correspondingly connected to the scanning signal end of each pixel compensation circuit in the pixel structures in the row so as to input a scanning signal to each pixel compensation circuit; and each column of data line is correspondingly connected to the data signal end of each pixel compensation circuit in each row of pixel structures in the column so as to input a data signal to each pixel compensation circuit.

For example, in the organic light emitting display panel, a high potential of a voltage of a control signal for controlling the switching transistors in each pixel compensation circuit is 20V to 30V, and a low potential of the voltage of the control signal is −8V.

For example, in the organic light emitting display panel provided by an embodiment of the present disclosure, the potential conversion circuit and the voltage input control circuit in each pixel structure may be prepared on an array substrate, and also may be prepared in a peripheral circuit chip, which is not limited herein. When the potential conversion circuit and the voltage input control circuit are prepared in the peripheral circuit chip, the high potential of the voltage of the control signal for controlling each switching transistor in two circuits is 3.3V for example, and the low potential of the voltage of the control signal is 0V for example.

A principle for solving problems, which is adopted by the organic light emitting display panel, is similar to that adopted by the pixel structure, and thus, implementation of the organic light emitting display panel can refer to implementation of the pixel structure, and is not repeated herein.

Based on the same inventive concept, an embodiment of the present disclosure further provides a display apparatus, including the organic light emitting display panel provided by the embodiment of the present disclosure. The display apparatus can be a display, a mobile phone, a television, a notebook computer, an all-in-one machine and the like, and all other essential components of the display apparatus shall be understood by those skilled in the art, are not repeated herein, and also should not limit the present disclosure.

The embodiments of the present disclosure provide the pixel structure, the driving method of the pixel structure, the organic light emitting display panel and the display apparatus. The pixel structure includes N light emitting devices, pixel compensation circuits connected with the light emitting devices in one-to-one correspondence, one potential conversion circuit and one voltage input control circuit; and a plurality of pixel compensation circuits are all connected with the same potential conversion circuit and the same voltage input control circuit (in this case, N is a positive integer greater than or equal to 2), which is equivalent to a case that a plurality of pixel compensation circuits share one potential conversion circuit and one voltage input control circuit, and compared with the mode that each pixel compensation circuit includes one control module for controlling the power voltage and the input of the reference signal, the mode adopted by the present disclosure can simplify the structure of each pixel compensation circuit, so that the occupation area of the pixel compensation circuits in the pixel regions (with reference to the regions 01 in FIG. 5) can be reduced, thereby improving the aperture ratio of each pixel region.

It is evident that one person skilled in the art can make various changes or modifications to the present disclosure without departure from the spirit and scope of the disclosure. Thus, if these changes and modifications to the present disclosure are within the scope of the claims of the present disclosure and equivalent technologies, the present disclosure also intends to include all such changes and modifications within its scope.

The application claims priority to the Chinese patent application No. 201610006810.7, filed Jan. 4, 2016, the entire disclosure of which is incorporated herein by reference as part of the present application.

What is claimed is:

1. A pixel structure, comprising N light emitting devices, a first power supply end, a second power supply end, a reference signal end, a first potential conversion end, a second potential conversion end, a charging control end, a light emitting control end, one potential conversion circuit, one voltage input control circuit, and pixel compensation circuits connected with first ends of the light emitting devices in one-to-one correspondence, wherein N is a positive integer greater than 0;

the potential conversion circuit comprises a first input end, a second input end, a third input end, a first control end, a second control end, a first output end and a second output end, the first input end is connected with the first power supply end, the second input end is connected with the second power supply end, the third input end is connected with the reference signal end, the first control end is connected with the first potential conversion end, the second control end is connected with the second potential conversion end, the first output end is connected with each pixel compensation circuit, and the second output end is connected with a second end of each light emitting device; the potential conversion circuit is configured to provide a voltage of the first power supply end to each light emitting device and simultaneously provide a voltage of the reference signal end to each pixel compensation circuit under control of the first potential conversion end, and respectively provide a voltage of the second power supply end to each light emitting device and each pixel compensation circuit under control of the second potential conversion end;

the voltage input control circuit comprises an input end, a first output end, a second output end, a first control end and a second control end, the input end is connected with the first power supply end, the first output end and the second output end of the voltage input control circuit are respectively connected with each pixel compensation circuit, the first control end of the voltage input control circuit is connected with the charging control end, and the second control end of the voltage input control circuit is connected with the light emitting control end; the voltage input control circuit is configured to provide the voltage of the first power supply end to each pixel compensation circuit under control of the charging control end so as to charge each pixel compensation circuit, and provide the voltage of the first power supply end to each pixel compensation circuit under control of each light emitting control end so as to control the pixel compensation circuit to drive the light emitting device to emit light; and both the voltage of the first power supply end and the voltage of the reference signal end are higher than the voltage of the second power supply end.

2. The pixel structure according to claim 1, wherein the pixel compensation circuit comprises: a data writing module, a compensation control module, a driving control module, a scanning signal end, a data signal end and a compensation control end, wherein the data writing module comprises a first end, a second end and a third end, the first end of the data writing module is connected with the scanning signal end, the second end of the data writing module is connected with the data signal end, and the third end of the data writing module is respectively connected with a first end of the driving control module and the first end of the light emitting device; the data writing module is configured to provide a signal of the data signal end to the first end of the driving control module under control of the scanning signal end;

the compensation control module comprises a first end, a second end, a third end and a fourth end, the first end of the compensation control module is connected with the compensation control end, the second end of the compensation control module is respectively connected with the first output end of the voltage input control circuit, a second end of the driving control module, and a first node, the third end of the compensation control module is respectively connected with the second output end of the voltage input control circuit and a third end of the driving control module, and the fourth end of the compensation control module is connected with the first output end of the potential conversion circuit and a second node; the compensation control module is configured to implement charging under control of the first output end of the potential conversion circuit and the first output end of the voltage input control circuit, and enable the first node to be electrically conducted with the first end of the driving control module under control of the compensation control end so as to store both a threshold voltage of the driving control module and a voltage of the first end of the driving control module to the first node; and the driving control module is configured to drive the light emitting device to emit light under control of the first node and the second output end of the voltage input control circuit.

3. The pixel structure according to claim 1, wherein the potential conversion circuit comprises: a first conversion module and a second conversion module, wherein the first conversion module is respectively connected with the first power supply end, the reference signal end, the first potential conversion end, the first output end of the potential conversion circuit, and the second output end of the potential conversion circuit; the first conversion module is configured to provide the voltage of the reference signal end to each pixel compensation circuit and simultaneously provide the voltage of the first power supply end to each light emitting device under control of the first potential conversion end;

the second conversion module is respectively connected with the second power supply end, the second potential conversion end, the first output end of the potential conversion circuit and the second output end of the potential conversion circuit; and the second conversion module is configured to respectively provide the voltage of the second power supply end to each light emitting device and each pixel compensation circuit under control of the second potential conversion end.

4. The pixel structure according to claim 3, wherein the first potential conversion end and the second potential conversion end are a same signal end.

5. The pixel structure according to claim 3, wherein the first conversion module comprises: a first switching transistor and a second switching transistor, wherein a gate electrode of the first switching transistor is connected with the first potential conversion end, a source electrode of the first switching transistor is connected with the first power supply end, and a drain electrode of the first switching transistor is connected with the second output end of the potential conversion circuit; and a gate electrode of the second switching transistor is connected with the first potential conversion end, a source electrode of the second switching transistor is connected with the reference signal end, and a drain electrode of the second switching transistor is connected with the first output end of the potential conversion circuit.

6. The pixel structure according to claim 3, wherein the second conversion module comprises: a third switching transistor and a fourth switching transistor, wherein a gate electrode of the third switching transistor is connected with the second potential conversion end, a source electrode of the third switching transistor is connected with the second power supply end, and a drain electrode of the third switching transistor is connected with the second output end of the potential conversion circuit; and a gate electrode of the fourth switching transistor is connected with the second potential conversion end, a source electrode of the fourth switching transistor is connected with the second power supply end, and a drain electrode of the fourth switching transistor is connected with the first output end of the potential conversion circuit.

7. The pixel structure according to claim 1, wherein the voltage input control circuit comprises: a fifth switching transistor and a sixth switching transistor, wherein a gate electrode of the fifth switching transistor is connected with the charging control end, a source electrode of the fifth switching transistor is connected with the first power supply end, and a drain electrode of the fifth switching transistor is connected with the first output end of the voltage input control circuit; and a gate electrode of the sixth switching transistor is connected with the light emitting control end, a source electrode of the sixth switching transistor is connected with the first power supply end, and a drain electrode of the sixth switching transistor is connected with the second output end of the voltage input control circuit.

8. The pixel structure according to claim 2, wherein the data writing module comprises: a seventh switching transistor, wherein a gate electrode of the seventh switching transistor is connected with the scanning signal end, a source electrode of the seventh switching transistor is connected with the data signal end, and a drain electrode of the seventh switching transistor is connected with the first end of the light emitting device.

9. The pixel structure according to claim 2, wherein the compensation control module comprises: an eighth switching transistor and a capacitor, wherein a gate electrode of the eighth switching transistor is connected with the compensation control end, a source electrode of the eighth switching transistor is connected with the second output end of the voltage input control circuit, and a source electrode of the eighth switching transistor is connected with the first node; and the capacitor is connected between the first node and the second node.

10. The pixel structure according to claim 2, wherein the driving control module comprises: a driving transistor, wherein a gate electrode of the driving transistor is connected with the first node, a source electrode of the driving transistor is connected with the second output end of the voltage input control circuit, and a drain electrode of the driving transistor is connected with the first end of the light emitting device.

11. The pixel structure according to claim 1, wherein N is greater than or equal to 2.

12. A driving method of the pixel structure according to claim 2, comprising: a charging stage, a discharging stage, a maintaining stage and a light emitting stage, wherein during the charging stage, the potential conversion circuit provides the voltage of the first power supply end to a second end of each light emitting device and simultaneously provides the voltage of the reference signal end to a second node in each pixel compensation circuit under control of the first potential conversion end; the voltage input control circuit provides the voltage of the first power supply end to a first node in each pixel compensation circuit under control of the charging control end; and the compensation control module implements charging under control of the first node and the second node together;

during the discharging stage, the potential conversion circuit provides the voltage of the first power supply end to the second end of each light emitting device and simultaneously provides the voltage of the reference signal end to the second node in each pixel compensation circuit under control of the first potential conversion end; the data writing module provides a signal of the data signal end to a first end of the driving control module under control of the scanning signal end; and the compensation control module enables the first node to be electrically conducted with the first end of the driving control module under control of the compensation control end and stores both a threshold voltage of the driving control module and a voltage of the first end of the driving control module to the first node;

during the maintaining stage, the potential conversion circuit respectively provides the voltage of the second power supply end to the second end of the light emitting device and the second node in each pixel compensation circuit under control of the second potential conversion end; and during the light emitting stage, the potential conversion circuit respectively provides the voltage of the second power supply end to the second end of each light emitting device and the second node in each pixel compensation circuit under control of the second potential conversion end; the voltage input control circuit provides the voltage of the first power supply end to a third end of the driving control module in each pixel compensation circuit under control of the light emitting control end; and the driving control module drives the light emitting device to emit light under control of the first node and the third end of the driving control module.

13. An organic light emitting display panel, comprising:

M columns of regions arranged in a matrix, and pixel structures each according to claim 1 and corresponding to each row of regions, wherein in each pixel structure, a number of the light emitting devices is the same;

M is equal to N; and both the light emitting devices and the pixel compensation circuits in each pixel structure are arranged in regions in the corresponding rows, and one light emitting device and one pixel compensation circuit connected with the one light emitting device are arranged in one of the regions.

14. A display apparatus, comprising the organic light emitting display panel according to claim 13.

15. The pixel structure according to claim 2, wherein the potential conversion circuit comprises: a first conversion module and a second conversion module, wherein the first conversion module is respectively connected with the first power supply end, the reference signal end, the first potential conversion end, the first output end of the potential conversion circuit, and the second output end of the potential conversion circuit; the first conversion module is configured to provide the voltage of the reference signal end to each pixel compensation circuit and simultaneously provide the voltage of the first power supply end to each light emitting device under control of the first potential conversion end;

the second conversion module is respectively connected with the second power supply end, the second potential conversion end, the first output end of the potential conversion circuit and the second output end of the potential conversion circuit; and the second conversion module is configured to respectively provide the voltage of the second power supply end to each light emitting device and each pixel compensation circuit under control of the second potential conversion end.

16. The pixel structure according to claim 4, wherein the first conversion module comprises: a first switching transistor and a second switching transistor, wherein a gate electrode of the first switching transistor is connected with the first potential conversion end, a source electrode of the first switching transistor is connected with the first power supply end, and a drain electrode of the first switching transistor is connected with the second output end of the potential conversion circuit; and a gate electrode of the second switching transistor is connected with the first potential conversion end, a source electrode of the second switching transistor is connected with the reference signal end, and a drain electrode of the second switching transistor is connected with the first output end of the potential conversion circuit.

17. The pixel structure according to claim 5, wherein the second conversion module comprises: a third switching transistor and a fourth switching transistor, wherein a gate electrode of the third switching transistor is connected with the second potential conversion end, a source electrode of the third switching transistor is connected with the second power supply end, and a drain electrode of the third switching transistor is connected with the second output end of the potential conversion circuit; and a gate electrode of the fourth switching transistor is connected with the second potential conversion end, a source electrode of the fourth switching transistor is connected with the second power supply end, and a drain electrode of the fourth switching transistor is connected with the first output end of the potential conversion circuit.

18. The pixel structure according to claim 8, wherein the compensation control module comprises: an eighth switching transistor and a capacitor, wherein a gate electrode of the eighth switching transistor is connected with the compensation control end, a source electrode of the eighth switching transistor is connected with the second output end of the voltage input control circuit, and a source electrode of the eighth switching transistor is connected with the first node; and the capacitor is connected between the first node and the second node.

19. The pixel structure according to claim 8, wherein the driving control module comprises: a driving transistor, wherein a gate electrode of the driving transistor is connected with the first node, a source electrode of the driving transistor is connected with the second output end of the voltage input control circuit, and a drain electrode of the driving transistor is connected with the first end of the light emitting device.

20. The pixel structure according to claim 9, wherein the driving control module comprises: a driving transistor, wherein a gate electrode of the driving transistor is connected with the first node, a source electrode of the driving transistor is connected with the second output end of the voltage input control circuit, and a drain electrode of the driving transistor is connected with the first end of the light emitting device.

* * * * *